US006764320B1

(12) United States Patent
Lenoir et al.

(10) Patent No.: US 6,764,320 B1
(45) **Date of Patent: *Jul. 20, 2004**

(54) CONNECTOR

(75) Inventors: Michel Lenoir, Montfort le Gesnois (FR); Jacky Thenaisie, Le Mans (FR); Michel Fonteneau, Le Mans (FR)

(73) Assignee: Framatome Connectors International, Versailles (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/108,687

(22) Filed: Jul. 1, 1998

(30) Foreign Application Priority Data

Jul. 8, 1997 (FR) ..... 97 08837

(51) Int. Cl.[7] ..... H01R 4/66
(52) U.S. Cl. ..... 439/101; 439/607; 439/892
(58) Field of Search ..... 439/79, 80, 83, 439/607–10, 629–30, 108–9, 100–2, 892, 149–150

(56) References Cited

U.S. PATENT DOCUMENTS

| | | | | | |
|---|---|---|---|---|---|
| 5,500,788 | A | * | 3/1996 | Longueville et al. | 439/108 |
| 5,507,655 | A | * | 4/1996 | Goerlich | 439/108 |
| 5,660,551 | A | * | 8/1997 | Sakurai | 439/108 |
| 5,842,887 | A | * | 12/1998 | Andrews | 439/608 |
| RE36,065 | E | * | 1/1999 | Andrews et al. | 439/608 |
| 5,890,917 | A | * | 4/1999 | Ishida et al. | 439/101 |

FOREIGN PATENT DOCUMENTS

| | | |
|---|---|---|
| EP | 0343561 A2 | 11/1989 |
| EP | 0446980 A1 | 9/1991 |
| EP | 0688064 A2 | 12/1995 |
| EP | 0700131 A1 | 3/1996 |

* cited by examiner

*Primary Examiner*—Lincoln Donovan
(74) *Attorney, Agent, or Firm*—Perman & Green, LLP

(57) ABSTRACT

A connector comprises a housing of insulating material and a plurality of signal and ground contacts regularly arranged in rows and columns within the housing. All contacts have first and second ends and an intermediate section. The first ends each include a connection section. The housing is provided with a front will having a grid of entrance openings leading to the connection sections. The housing is provided with an air chamber and all contacts extend along a part of their length through this air chamber.

7 Claims, 4 Drawing Sheets

CONNECTOR

The invention relates to a high density connector, comprising a housing of insulating material and a plurality of signal and ground contacts regularly arranged in rows and columns within said housing, each of said contacts having first and second ends and an intermediate section, said first ends each including a connection section, wherein said housing is provided with a front will having a grid of entrance openings leading to said connection sections.

EP-A-0 446 980 discloses a connector of this type. In this known connector the signal contacts are mounted in a dielectric insert surrounded by an outer conductor. Although the impedance of the signal contacts can be determined in this manner, manufacturing the connector is relatively complicated. Further, increasing the density of the contacts would significantly increase the complexity of the connector.

The invention aims to provide a connector of the above-mentioned type wherein the impedance of the contacts can be improved in a simple manner.

According to the invention, the connector is characterized in that said housing is provided with an air chamber, all contacts extending along a part of their length through said air chamber.

The invention will be further explained by reference to the drawings in which two embodiments of the connector according to the invention is shown.

Figure 1:
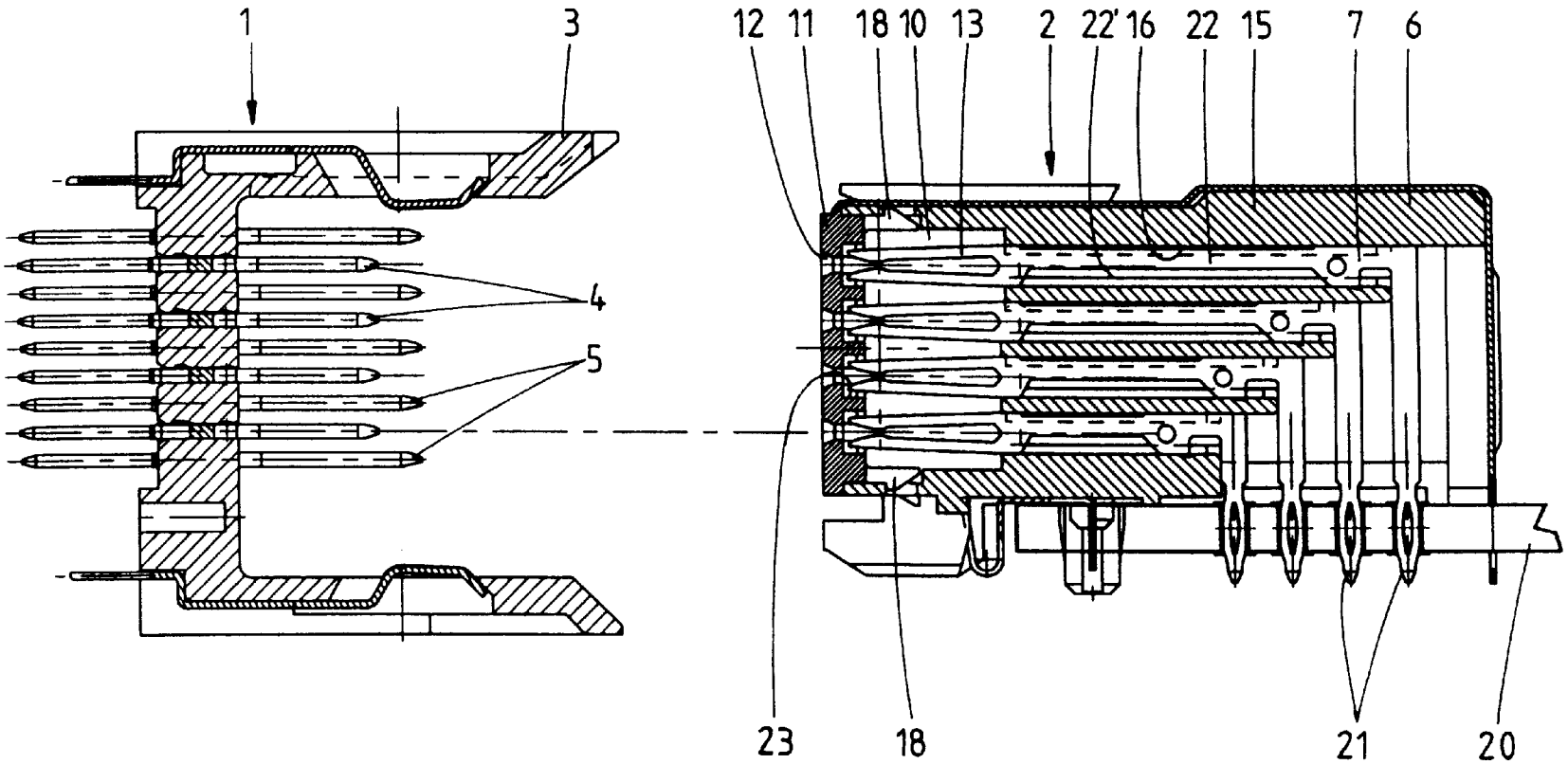
FIG. 1 shows a cross-section through a column of signal contacts of a connector assembly comprising a male connector and an embodiment of a female connector according to the invention, wherein the connectors are disconnected.
Figure 3:
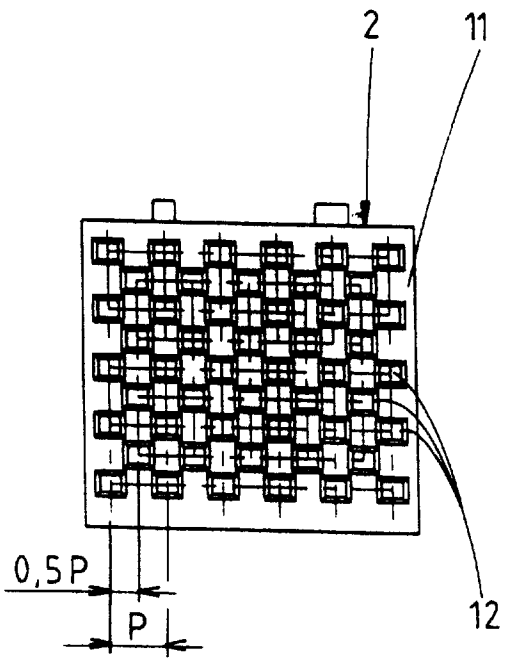
FIG. 3 shows a front view of the female connector of FIG. 1.
Figure 2:
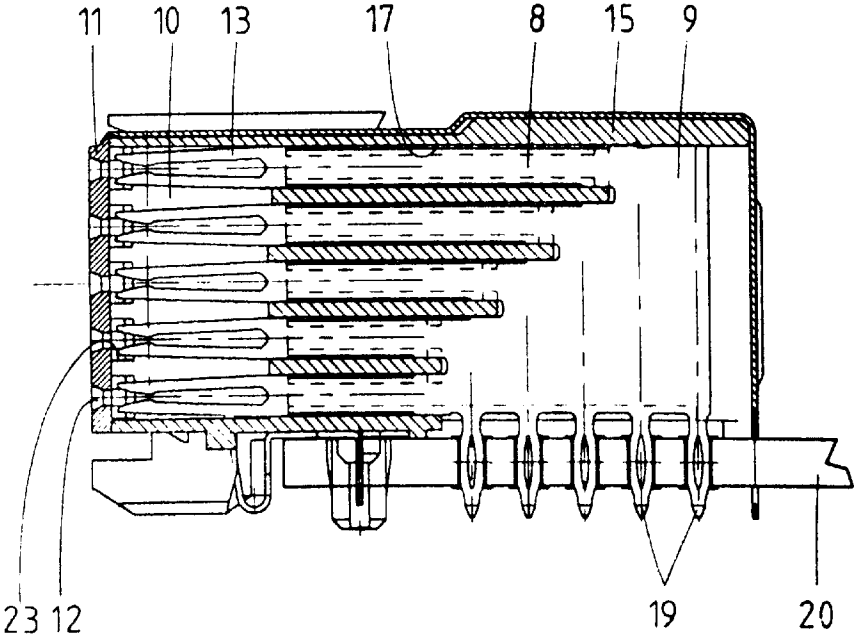
FIG. 2 shows a cross-section through a column of ground contacts of the female connector of FIG. 1.

Referring to FIGS. 1–3 there is shown a connector assembly for printed circuit boards, comprising a male connector 1 and a female connector 2. The male connector 1 comprises a first housing 3 of insulating material and a plurality of male signal contacts 4 and a plurality of male ground contacts 5. In the embodiment shown the length of the ground contacts 5 is greater than the length of the signal contacts 4. However, the signal and ground contacts may have equal lengths.

The female connector 2 comprises a second housing 6 of insulating material and a plurality of female signal contacts 7 and a plurality of female ground contacts 8, wherein the ground contacts of one column are part of a ground contact element 9 as shown in FIG. 2.

In order to increase the density of contacts, the signal and ground contacts 4, 5 and 8, 9 are arranged in a special manner as can be seen in the front view of the female connector 2 in FIG. 3. All contacts are regularly arranged in rows and columns, wherein in each row and column all contacts 4, 5 and 8, 9 are arranged at an equal pitch p in row and column direction. Further, each row and each column of signal contacts 4 or 8 contains signal contacts only and each row and each column of ground contacts 5 or 9 contains ground contacts only. As can be seen in FIG. 3, successive rows of contacts 8, 9 are staggered in row direction by half the pitch p of the contacts, wherein the rows and columns of contacts have a pitch equal to half the pitch p of the contacts. In this manner a pitch half p of the contacts in adjacent rows and columns can be obtained. At a pitch of for example 2 mm, the pitch between adjacent contacts 4, 5 and 8, 9 will be 1 mm. This arrangement of contacts for increasing the density of the contacts is described in detail in a patent application of the same date of the same applicant, which application is incorporated here by reference.

In the female connector 2, the impedance of the signal contacts 7 is improved by providing the housing 6 with an air chamber 10 at the front side of the connector 2. As shown in FIGS. 1 and 2, the housing 6 comprises a front wall 11 having a grid of entrance openings 12 leading to fork-shaped connection sections 13 of the signal and ground contacts 7, 8. The housing 6 further comprises a contact supporting part 15 provided with passages 16 and 17 for the female signal contacts 7 and ground contacts 8, respectively. As schematically shown in FIG. 1, the front wall 11 is detachably attached to the contact supporting part 15 by means of hooks 18.

As shown in FIG. 2, the female ground contacts 8 of one column are part of a ground contact element 9 having a plurality of press-fit terminations 19 connected to the plated through-holes of a printed circuit board 20. The female signal contacts 7 are also provided with press-fit terminations 21 connected to plated through-holes of the printed circuit board 20. The female signal contacts 7 having the connection section 13 as first end and the press-fit termination 21 as second end, include an intermediate section 22 extending through the corresponding passage 16 of the contact supporting part 15 of the house 6.

As can be seen in FIGS. 1 and 2 the connection sections 13 of the contacts 7, 8 extend through the air chamber 10 into corresponding recesses 23 provided at the inner side of the front wall 11 at the location of each entrance opening 12. In this manner the recesses 23 receive and align the connection sections 13 of the contacts with the corresponding entrance openings 12.

The impedance of the signal contacts 7 is significantly improved because the connection sections 13 extend through air as dielectric. The impedance can be further improved by a special design of the intermediate sections 22 of the signal contacts 7 as shown in FIG. 1. A part of the intermediate section 22 is removed so that air is present as dielectric along this,removed length of the intermediate sections as indicated by 22'. This means that the height of the intermediate section 22 is less than the height of the corresponding passage 16.

Figure 4:
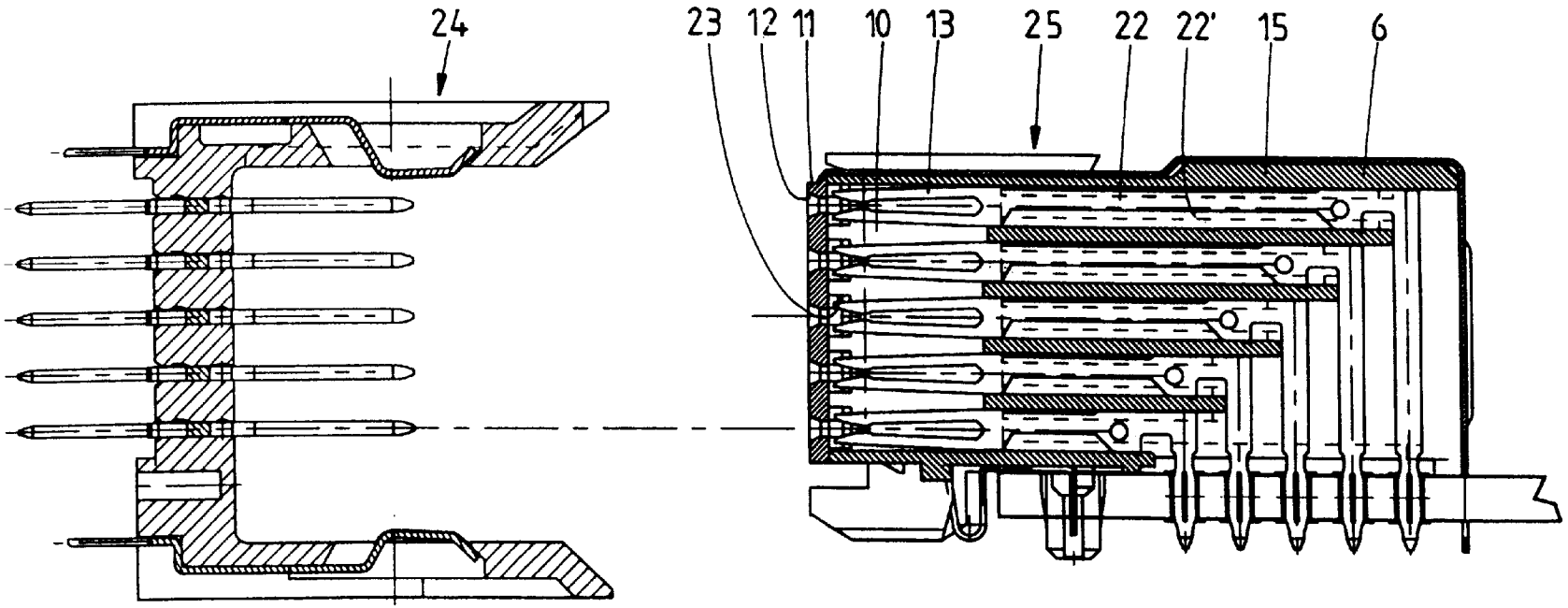
FIG. 4 shows a cross-section through a column of signal contacts of a connector assembly comprising a second embodiment of the female connector according to the invention.
Figure 5:
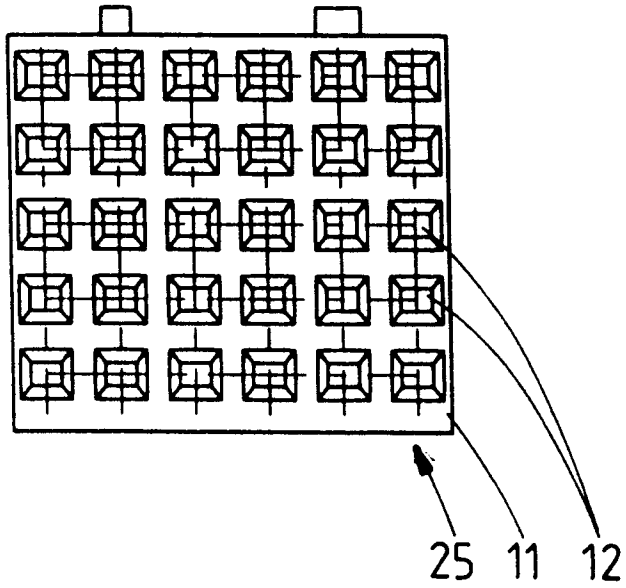
FIG. 5 shows a front view of the female connector of FIG. 4.

FIG. 4 shows a cross-section of a further connector assembly comprising a male connector 24 and a female connector 25, wherein the female connector 25 is mainly in the same manner as the female connector 2 of FIGS. 1–3. However, in this case the pitch of adjacent contacts is 2 mm and the rows of contacts are not staggered as can be seen in the front view of the female connector 25 shown in FIG. 5. The housing 6 of the connector 25 is made in the same manner with a front wall 11 and a contact supporting part 15, wherein the connection sections 13 extend through an air chamber 10 into recesses 23 at the inner side of the front wall 11. Further the intermediate sections 22 of the female signal contacts 7 are made in the same manner as in the connector 7. In this manner again the impedance of the signal contacts is improved.

Although the invention has been explained with reference to a female connector for a printed circuit board, it will be understood that the invention can also be used in other types of connectors, for example connectors with male contacts and connectors for cables.

The invention is not restricted to the above described embodiments which can be varied in a number of ways within the scope of the claims.

What is claimed is:

1. A connector with a high density of contacts comprising:

a housing;

a plurality of signal and ground contacts arranged in rows and columns within the housing, each of the signal and ground contacts having a first end, a second end and an intermediate section between the first end and the second end; and a detachable wall in a front portion of the housing having a grid of entrance openings, each entrance opening leading to a connection section at the first end of each signal and ground contact, wherein when the detachable wall is in a hooked position a first air chamber is formed within the front portion of the housing, the connection sections of the signal and ground contacts extending through the first air chamber into a corresponding recess in an inner side of the front wall at each entrance opening, the first air chamber forming a first dielectric around each connection section and wherein an impedance of each signal contact is improved by the first dielectric.

2. Connector according to claim 1, wherein said air chamber is located adjacent to said front wall, all connection sections being located in said air chamber.

3. Connector according to claim 1, wherein the ground contacts of a row of the ground contacts are part of a ground contact element.

4. Connector according to claim 1, wherein in each row and each column all contacts are arranged at an equal pitch in a row direction and a column direction, wherein successive rows of contacts are staggered in the row direction by half the pitch of the contacts, wherein each row and each column of contacts contain only signal or only ground contacts, respectively, and wherein the rows and columns of contacts have a pitch equal to half the pitch of the contacts.

5. Connector according to claim 1, wherein the housing comprises at least the front wall and a contact supporting part, wherein the front wall is detachably attached to the contact supporting part.

6. Connector according to claim 5, wherein the front wall is provided with a recess at an inner side at a location of each entrance opening for at least all signal contacts, said recesses receiving and aligning the connection section of each contact with the corresponding entrance opening.

7. The connector of claim 1, further comprising a contact supporting section in the housing including a passageway for each of the signal and ground contacts, and wherein the intermediate section of each signal contact includes a reduced height portion forming a second air chamber in a portion of the passageway, the second air chamber forming a second dielectric along a length of the reduced height portion of the signal contact, and wherein the impedance of each signal contact is improved by the second dielectric.

* * * * *

UNITED STATES PATENT AND TRADEMARK OFFICE

CERTIFICATE OF CORRECTION

PATENT NO. : 6,764,320 B1
DATED : July 20, 2004
INVENTOR(S) : Lenoir et al.

It is certified that error appears in the above-identified patent and that said Letters Patent is hereby corrected as shown below:

Column 3,
Line 18, "sections", should read -- section --.
Line 18, delete "the" and insert -- each --.
Line 18, "contacts" should read -- contact --.
Line 20, delete "front" and insert -- detachable --.
Line 21, after "opening", insert -- the air in --.

Signed and Sealed this

Thirty-first Day of May, 2005

JON W. DUDAS
*Director of the United States Patent and Trademark Office*